US009759064B2

(12) United States Patent
Jeffries

(10) Patent No.: US 9,759,064 B2
(45) **Date of Patent: *Sep. 12, 2017**

(54) FORMATION TESTING IN MANAGED PRESSURE DRILLING

(71) Applicant: HALLIBURTON ENERGY SERVICES, INC., Houston, TX (US)

(72) Inventor: Stuart M. Jeffries, Mudgeeraba (AU)

(73) Assignee: Halliburton Energy Services, Inc., Houston, TX (US)

( * ) Notice: Subject to any disclaimer, the term of this patent is extended or adjusted under 35 U.S.C. 154(b) by 454 days.

This patent is subject to a terminal disclaimer.

(21) Appl. No.: 14/300,173

(22) Filed: Jun. 9, 2014

(65) Prior Publication Data

US 2014/0284106 A1 Sep. 25, 2014

Related U.S. Application Data

(63) Continuation of application No. 13/546,117, filed on Jul. 11, 2012, now Pat. No. 8,783,381.

(51) Int. Cl.

| | |
|---|---|
| ***E21B 49/00*** | (2006.01) |
| ***E21B 21/08*** | (2006.01) |
| ***E21B 49/08*** | (2006.01) |

(52) U.S. Cl.

CPC ..... *E21B 49/00* (2013.01); *E21B 21/08* (2013.01); *E21B 49/003* (2013.01); *E21B 49/08* (2013.01)

(58) Field of Classification Search

CPC ..... E21B 47/10; E21B 21/08

See application file for complete search history.

(56) References Cited

U.S. PATENT DOCUMENTS

| | | | |
|---|---|---|---|
| 4,355,784 | A | 10/1982 | Cain |
| 4,570,480 | A | 2/1986 | Fontenot et al. |

(Continued)

FOREIGN PATENT DOCUMENTS

| | | | |
|---|---|---|---|
| CN | 103635655 | A | 3/2014 |
| EP | 1936112 | A2 | 6/2008 |

(Continued)

OTHER PUBLICATIONS

International Search Report with Written Opinion issued Oct. 13, 2010 for PCT Patent Application No. PCT/US10/020122, 13 pages.

(Continued)

*Primary Examiner* — Robert E Fuller

(74) *Attorney, Agent, or Firm* — Chamberlain Hrdlicka

(57) ABSTRACT

A method of testing an earth formation can include incrementally opening a choke while drilling into the formation is ceased, thereby reducing pressure in a wellbore, and detecting an influx into the wellbore due to the reducing pressure in the wellbore. Another method of testing an earth formation can include drilling into the formation, with an annulus between a drill string and a wellbore being pressure isolated from atmosphere, then incrementally opening a choke while drilling is ceased, thereby reducing pressure in the wellbore, detecting an influx into the wellbore due to the reducing pressure in the wellbore, and determining approximate formation pore pressure as pressure in the wellbore when the influx is detected. Drilling fluid may or may not flow through the drill string when the influx is detected. A downhole pressure sensor can be used to verify pressure in the wellbore.

16 Claims, 4 Drawing Sheets

(56) References Cited

U.S. PATENT DOCUMENTS

| | | | | |
|---|---|---|---|---|
| 5,303,582 | A | 4/1994 | Miska | |
| 6,173,768 | B1 | 1/2001 | Watson | |
| 6,484,816 | B1 | 11/2002 | Koederitz | |
| 6,668,943 | B1 | 12/2003 | Maus et al. | |
| 7,650,950 | B2 | 1/2010 | Leuchtenberg | |
| 7,806,202 | B2 | 10/2010 | Stewart | |
| 7,836,973 | B2 | 11/2010 | Belcher et al. | |
| 8,783,381 | B2 | 7/2014 | Jeffries | |
| 2002/0092655 | A1 | 7/2002 | Fincher et al. | |
| 2002/0134587 | A1 | 9/2002 | Rester et al. | |
| 2003/0075361 | A1* | 4/2003 | Terry | G01V 3/30 175/61 |
| 2003/0098181 | A1 | 5/2003 | Aronstam et al. | |
| 2003/0220742 | A1 | 11/2003 | Niedermayr et al. | |
| 2003/0234120 | A1 | 12/2003 | Paluch et al. | |
| 2004/0040746 | A1 | 3/2004 | Niedermayr et al. | |
| 2005/0092523 | A1 | 5/2005 | McCaskill | |
| 2005/0098349 | A1 | 5/2005 | Krueger et al. | |
| 2006/0207795 | A1 | 9/2006 | Kinder et al. | |
| 2007/0168056 | A1 | 7/2007 | Shayegi et al. | |
| 2007/0221407 | A1 | 9/2007 | Bostick et al. | |
| 2007/0246263 | A1 | 10/2007 | Reitsma | |
| 2008/0041149 | A1 | 2/2008 | Leuchtenberg | |
| 2008/0060846 | A1 | 3/2008 | Belcher et al. | |
| 2008/0154510 | A1 | 6/2008 | Scott | |
| 2009/0159334 | A1 | 6/2009 | Alberty | |
| 2010/0186960 | A1 | 7/2010 | Reitsma et al. | |
| 2011/0067923 | A1* | 3/2011 | Leuchtenberg | E21B 21/08 175/57 |
| 2011/0214882 | A1 | 9/2011 | Santos | |
| 2012/0165997 | A1 | 6/2012 | Lewis | |

FOREIGN PATENT DOCUMENTS

| | | | |
|---|---|---|---|
| GB | 2156403 | A | 10/1985 |
| RU | 2245984 | C2 | 2/2005 |
| WO | 9949172 | A1 | 9/1999 |
| WO | 2007005822 | A2 | 1/2007 |
| WO | 2009111412 | A2 | 9/2009 |

OTHER PUBLICATIONS

International Search Report with Written Opinion issued Jun. 17, 2011 for PCT Patent Application No. PCT/US10/056433, 9 pages.

International Search Report with Written Opinion issued Dec. 21, 2011 for PCT Patent Application No. PCT/US11/031790, 15 pages.

International Search Report with Written Opinion issued Feb. 17, 2012 for PCT Patent Application No. PCT/US11/043750, 11 pages.

Mi Swaco; "10k Super AutoChoke", product bulletin MS-04104, dated Aug. 2004, 4 pages.

IADC Well Control Europe; "Well Control in an Increasingly Complex and Changing Environment", Conference and Exhibition 2010, dated Apr. 13-14, 2010, 4 pages.

Office Action issued Jan. 9, 2013 for U.S. Appl. No. 13/546,117, 10 pages.

Office Action issued May 1, 2013 for U.S. Appl. No. 13/546,117, 14 pages.

Office Action issued Jan. 30, 2013 for U.S. Appl. No. 13/546,117, 8 pages.

* cited by examiner 100
102
DRILLING AHEAD
104
CEASE DRILLING
106
CEASE CIRCULATION
MONITOR FLOW OUT
INCREMENTALLY OPEN CHOKE
108
110
112
FLOW OUT?
NO
YES
114
DETERMINE PORE PRESSURE
116
CIRCULATE
118
VERIFY WITH DOWNHOLE SENSORS(S)
120
RESUME DRILLING

FORMATION TESTING IN MANAGED PRESSURE DRILLING

CROSS-REFERENCE TO RELATED APPLICATIONS

This application is a continuation of U.S. application Ser. No. 13/546,117 filed on 11 Jul. 2012, which claims the benefit under 35 USC §119 of the filing date of International Application Serial No. PCT/US11/43750 filed 12 Jul. 2011. The entire disclosures of these prior applications are incorporated herein by this reference.

BACKGROUND

The present disclosure relates generally to equipment utilized and operations performed in conjunction with well drilling operations and, in an embodiment described herein, more particularly provides for formation testing in managed pressure drilling.

Managed pressure drilling is well known as the art of precisely controlling bottom hole pressure during drilling by utilizing a closed annulus and a means for regulating pressure in the annulus. The annulus is typically closed during drilling through use of a rotating control device (RCD, also known as a rotating control head or rotating blowout preventer) which seals about the drill pipe as it rotates.

It will, therefore, be appreciated that it would be beneficial to be able to perform formation testing during managed pressure drilling operations.

DETAILED DESCRIPTION

Figure 1:
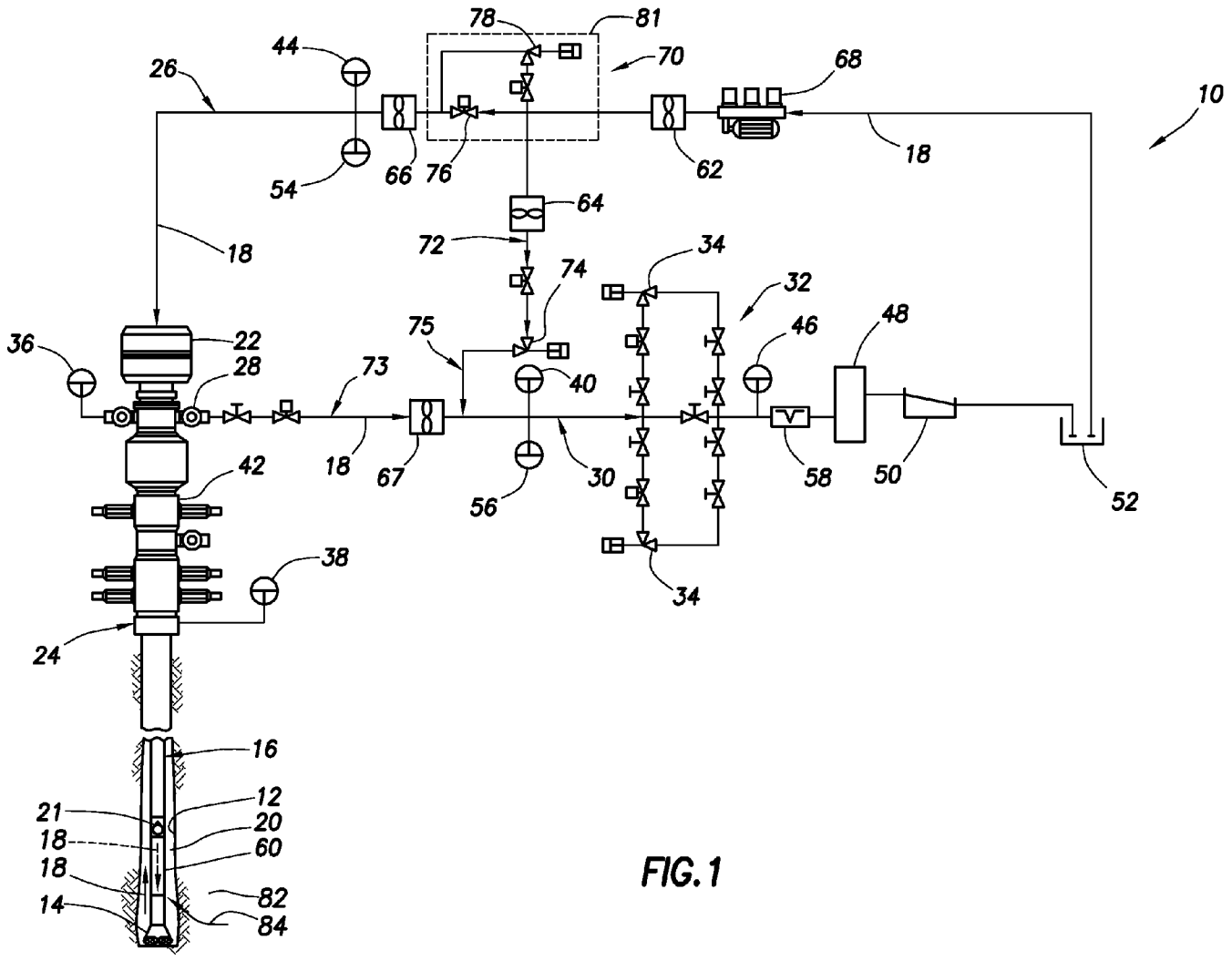
FIG. 1 is a representative view of a well drilling system and method which can embody principles of the present disclosure.

Representatively illustrated in FIG. 1 is a well drilling system 10 and associated method which can embody principles of the present disclosure. In the system 10, a wellbore 12 is drilled by rotating a drill bit 14 on an end of a drill string 16. Drilling fluid 18, commonly known as mud, is circulated downward through the drill string 16, out the drill bit 14 and upward through an annulus 20 formed between the drill string and the wellbore 12, in order to cool the drill bit, lubricate the drill string, remove cuttings and provide a measure of bottom hole pressure control. A non-return valve 21 (typically a flapper-type check valve) prevents flow of the drilling fluid 18 upward through the drill string 16 (e.g., when connections are being made in the drill string).

Control of bottom hole pressure is very important in managed pressure drilling, and in other types of drilling operations. Preferably, the bottom hole pressure is precisely controlled to prevent excessive loss of fluid into an earth formation 82 surrounding the wellbore 12, undesired fracturing of the formation, undesired influx of formation fluids into the wellbore, etc.

In typical managed pressure drilling, it is desired to maintain the bottom hole pressure just slightly greater than a pore pressure of the formation, without exceeding a fracture pressure of the formation. This technique is especially useful in situations where the margin between pore pressure and fracture pressure is relatively small.

In typical underbalanced drilling, it is desired to maintain the bottom hole pressure somewhat less than the pore pressure, thereby obtaining a controlled influx of fluid from the formation.

In conventional overbalanced drilling, it is desired to maintain the bottom hole pressure somewhat greater than the pore pressure, thereby preventing (or at least mitigating) influx of fluid from the formation. The annulus 20 can be open to the atmosphere at the surface during overbalanced drilling, and wellbore pressure is controlled during drilling by adjusting a density of the drilling fluid 18.

Nitrogen or another gas, or another lighter weight fluid, may be added to the drilling fluid 18 for pressure control. This technique is useful, for example, in underbalanced drilling operations.

In the system 10, additional control over the bottom hole pressure is obtained by closing off the annulus 20 (e.g., isolating it from communication with the atmosphere and enabling the annulus to be pressurized at or near the surface) using a rotating control device 22 (RCD). The RCD 22 seals about the drill string 16 above a wellhead 24. Although not shown in FIG. 1, the drill string 16 would extend upwardly through the RCD 22 for connection to, for example, a rotary table (not shown), a standpipe line 26, kelley (not shown), a top drive and/or other conventional drilling equipment.

The drilling fluid 18 exits the wellhead 24 via a wing valve 28 in communication with the annulus 20 below the RCD 22. The fluid 18 then flows through mud return lines 30, 73 to a choke manifold 32, which includes redundant chokes 34 (only one of which might be used at a time). Backpressure is applied to the annulus 20 by variably restricting flow of the fluid 18 through the operative one(s) of the redundant choke(s) 34.

The greater the restriction to flow through the operative choke(s) 34, the greater the backpressure applied to the annulus 20. Thus, downhole pressure (e.g., pressure at the bottom of the wellbore 12, pressure at a downhole casing shoe, pressure at a particular formation or zone, etc.) can be conveniently regulated by varying the backpressure applied to the annulus 20. A hydraulics model can be used, as described more fully below, to determine a pressure applied to the annulus 20 at or near the surface which will result in a desired downhole pressure, so that an operator (or an automated control system) can readily determine how to regulate the pressure applied to the annulus at or near the surface (which can be conveniently measured) in order to obtain the desired downhole pressure.

Pressure applied to the annulus 20 can be measured at or near the surface via a variety of pressure sensors 36, 38, 40, each of which is in communication with the annulus. Pressure sensor 36 senses pressure below the RCD 22, but above a blowout preventer (BOP) stack 42. Pressure sensor 38 senses pressure in the wellhead below the BOP stack 42. Pressure sensor 40 senses pressure in the mud return lines 30, 73 upstream of the choke manifold 32.

Another pressure sensor 44 senses pressure in the standpipe line 26. Yet another pressure sensor 46 senses pressure downstream of the choke manifold 32, but upstream of a separator 48, shaker 50 and mud pit 52. Additional sensors include temperature sensors 54, 56, Coriolis flowmeter 58, and flowmeters 62, 64, 66.

Not all of these sensors are necessary. For example, the system 10 could include only two of the three flowmeters 62, 64, 66. However, input from all available sensors is useful to the hydraulics model in determining what the pressure applied to the annulus 20 should be during the drilling operation.

Other sensor types may be used, if desired. For example, it is not necessary for the flowmeter 58 to be a Coriolis flowmeter, since a turbine flowmeter, acoustic flowmeter, or another type of flowmeter could be used instead.

In addition, the drill string 16 may include its own sensors 60, for example, to directly measure downhole pressure. Such sensors 60 may be of the type known to those skilled in the art as pressure while drilling (PWD), measurement while drilling (MWD) and/or logging while drilling (LWD). These drill string sensor systems generally provide at least pressure measurement, and may also provide temperature measurement, detection of drill string characteristics (such as vibration, weight on bit, stick-slip, etc.), formation characteristics (such as resistivity, density, etc.) and/or other measurements. Various forms of wired or wireless telemetry (acoustic, pressure pulse, electromagnetic, etc.) may be used to transmit the downhole sensor measurements to the surface. For example, lines (such as, electrical, optical, hydraulic, etc., lines) could be provided in a wall of the drill string 16 for communicating power, data, commands, pressure, flow, etc.

Additional sensors could be included in the system 10, if desired. For example, another flowmeter 67 could be used to measure the rate of flow of the fluid 18 exiting the wellhead 24, another Coriolis flowmeter (not shown) could be interconnected directly upstream or downstream of a rig mud pump 68, etc.

Fewer sensors could be included in the system 10, if desired. For example, the output of the rig mud pump 68 could be determined by counting pump strokes, instead of by using the flowmeter 62 or any other flowmeters.

Note that the separator 48 could be a 3 or 4 phase separator, or a mud gas separator (sometimes referred to as a "poor boy degasser"). However, the separator 48 is not necessarily used in the system 10.

The drilling fluid 18 is pumped through the standpipe line 26 and into the interior of the drill string 16 by the rig mud pump 68. The pump 68 receives the fluid 18 from the mud pit 52 and flows it via a standpipe manifold 70 to the standpipe 26. The fluid then circulates downward through the drill string 16, upward through the annulus 20, through the mud return lines 30, 73, through the choke manifold 32, and then via the separator 48 and shaker 50 to the mud pit 52 for conditioning and recirculation.

Note that, in the system 10 as so far described above, the choke 34 cannot be used to control backpressure applied to the annulus 20 for control of the downhole pressure, unless the fluid 18 is flowing through the choke. In conventional overbalanced drilling operations, a lack of fluid 18 flow will occur, for example, whenever a connection is made in the drill string 16 (e.g., to add another length of drill pipe to the drill string as the wellbore 12 is drilled deeper), and the lack of circulation will require that downhole pressure be regulated solely by the density of the fluid 18.

In the system 10, however, flow of the fluid 18 through the choke 34 can be maintained, even though the fluid does not circulate through the drill string 16 and annulus 20, while a connection is being made in the drill string. Thus, pressure can still be applied to the annulus 20 by restricting flow of the fluid 18 through the choke 34, even though a separate backpressure pump may not be used. However, in other examples, a backpressure pump (not shown) could be used to supply pressure to the annulus 20 while the fluid 18 does not circulate through the drill string 16, if desired.

In the example of FIG. 1, when fluid 18 is not circulating through drill string 16 and annulus 20 (e.g., when a connection is made in the drill string), the fluid is flowed from the pump 68 to the choke manifold 32 via a bypass line 72, 75. Thus, the fluid 18 can bypass the standpipe line 26, drill string 16 and annulus 20, and can flow directly from the pump 68 to the mud return line 30, which remains in communication with the annulus 20. Restriction of this flow by the choke 34 will thereby cause pressure to be applied to the annulus 20 (for example, in typical managed pressure drilling).

As depicted in FIG. 1, both of the bypass line 75 and the mud return line 30 are in communication with the annulus 20 via a single line 73. However, the bypass line 75 and the mud return line 30 could instead be separately connected to the wellhead 24, for example, using an additional wing valve (e.g., below the RCD 22), in which case each of the lines 30, 75 would be directly in communication with the annulus 20.

Although this might require some additional piping at the rig site, the effect on the annulus pressure would be essentially the same as connecting the bypass line 75 and the mud return line 30 to the common line 73. Thus, it should be appreciated that various different configurations of the components of the system 10 may be used, without departing from the principles of this disclosure.

Flow of the fluid 18 through the bypass line 72, 75 is regulated by a choke or other type of flow control device 74. Line 72 is upstream of the bypass flow control device 74, and line 75 is downstream of the bypass flow control device.

Flow of the fluid 18 through the standpipe line 26 is substantially controlled by a valve or other type of flow control device 76. Note that the flow control devices 74, 76 are independently controllable, which provides substantial benefits to the system 10, as described more fully below.

Since the rate of flow of the fluid 18 through each of the standpipe and bypass lines 26, 72 is useful in determining how bottom hole pressure is affected by these flows, the flowmeters 64, 66 are depicted in FIG. 1 as being interconnected in these lines. However, the rate of flow through the standpipe line 26 could be determined even if only the flowmeters 62, 64 were used, and the rate of flow through the bypass line 72 could be determined even if only the flowmeters 62, 66 were used. Thus, it should be understood that it is not necessary for the system 10 to include all of the sensors depicted in FIG. 1 and described herein, and the system could instead include additional sensors, different combinations and/or types of sensors, etc.

In another beneficial feature of the system 10, a bypass flow control device 78 may be used for filling the standpipe line 26 and drill string 16 after a connection is made in the drill string, and for equalizing pressure between the standpipe line and mud return lines 30, 73 prior to opening the flow control device 76. Otherwise, sudden opening of the flow control device 76 prior to the standpipe line 26 and drill string 16 being filled and pressurized with the fluid 18 could cause an undesirable pressure transient in the annulus 20 (e.g., due to flow to the choke manifold 32 temporarily being lost while the standpipe line and drill string fill with fluid, etc.).

By opening the standpipe bypass flow control device 78 after a connection is made, the fluid 18 is permitted to fill the standpipe line 26 and drill string 16 while a substantial majority of the fluid continues to flow through the bypass line 72, thereby enabling continued controlled application of pressure to the annulus 20. After the pressure in the standpipe line 26 has equalized with the pressure in the mud return lines 30, 73 and bypass line 75, the flow control device 76 can be opened, and then the flow control device 74 can be closed to slowly divert a greater proportion of the fluid 18 from the bypass line 72 to the standpipe line 26.

Before a connection is made in the drill string 16, a similar process can be performed, except in reverse, to gradually divert flow of the fluid 18 from the standpipe line 26 to the bypass line 72 in preparation for adding more drill pipe to the drill string 16. That is, the flow control device 74 can be gradually opened to slowly divert a greater proportion of the fluid 18 from the standpipe line 26 to the bypass line 72, and then the flow control device 76 can be closed.

Note that the flow control devices 76, 78 could be integrated into a single flow control device 81 (e.g., a single choke which can gradually open to slowly fill and pressurize the standpipe line 26 and drill string 16 after a drill pipe connection is made, and then open fully to allow maximum flow while drilling). However, since typical conventional drilling rigs are equipped with the flow control device 76 in the form of a valve in the standpipe manifold 70, and use of the standpipe valve is incorporated into usual drilling practices, the individually operable flow control devices 76, 78 are presently preferred.

Figure 2:
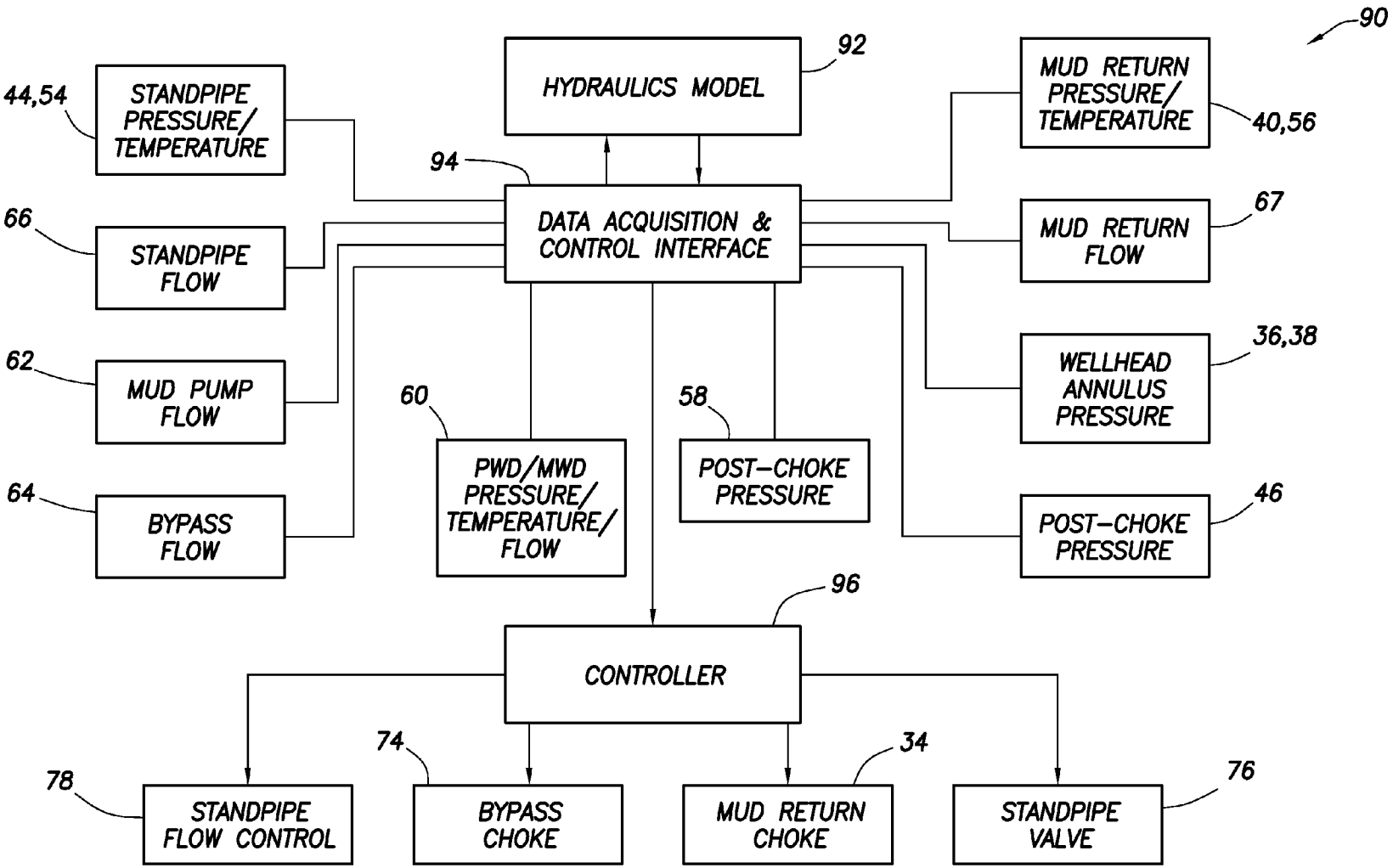
FIG. 2 is a representative block diagram of a pressure and flow control system which may be used in the well drilling system and method.

A pressure and flow control system 90 which may be used in conjunction with the system 10 and associated method of FIG. 1 is representatively illustrated in FIG. 2. The control system 90 is preferably fully automated, although some human intervention may be used, for example, to safeguard against improper operation, initiate certain routines, update parameters, etc.

The control system 90 includes a hydraulics model 92, a data acquisition and control interface 94 and a controller 96 (such as a programmable logic controller or PLC, a suitably programmed computer, etc.). Although these elements 92, 94, 96 are depicted separately in FIG. 2, any or all of them could be combined into a single element, or the functions of the elements could be separated into additional elements, other additional elements and/or functions could be provided, etc.

The hydraulics model 92 is used in the control system 90 to determine the desired annulus pressure at or near the surface to achieve the desired downhole pressure. Data such as well geometry, fluid properties and offset well information (such as geothermal gradient and pore pressure gradient, etc.) are utilized by the hydraulics model 92 in making this determination, as well as real-time sensor data acquired by the data acquisition and control interface 94.

Thus, there is a continual two-way transfer of data and information between the hydraulics model 92 and the data acquisition and control interface 94. It is important to appreciate that the data acquisition and control interface 94 operates to maintain a substantially continuous flow of real-time data from the sensors 44, 54, 66, 62, 64, 60, 58, 46, 36, 38, 40, 56, 67 to the hydraulics model 92, so that the hydraulics model has the information it needs to adapt to changing circumstances and to update the desired annulus pressure, and the hydraulics model operates to supply the data acquisition and control interface substantially continuously with a value for the desired annulus pressure.

A suitable hydraulics model for use as the hydraulics model 92 in the control system 90 is REAL TIME HYDRAULICS™ provided by Halliburton Energy Services, Inc. of Houston, Tex. USA. Another suitable hydraulics model is provided under the trade name IRIS™, and yet another is available from SINTEF of Trondheim, Norway. Any suitable hydraulics model may be used in the control system 90 in keeping with the principles of this disclosure.

A suitable data acquisition and control interface for use as the data acquisition and control interface 94 in the control system 90 are SENTRY™ and INSITE™ provided by Halliburton Energy Services, Inc. Any suitable data acquisition and control interface may be used in the control system 90 in keeping with the principles of this disclosure.

The controller 96 operates to maintain a desired setpoint annulus pressure by controlling operation of the mud return choke 34. When an updated desired annulus pressure is transmitted from the data acquisition and control interface 94 to the controller 96, the controller uses the desired annulus pressure as a setpoint and controls operation of the choke 34 in a manner (e.g., increasing or decreasing flow resistance through the choke as needed) to maintain the setpoint pressure in the annulus 20. The choke 34 can be closed more to increase flow resistance, or opened more to decrease flow resistance.

Maintenance of the setpoint pressure is accomplished by comparing the setpoint pressure to a measured annulus pressure (such as the pressure sensed by any of the sensors 36, 38, 40), and decreasing flow resistance through the choke 34 if the measured pressure is greater than the setpoint pressure, and increasing flow resistance through the choke if the measured pressure is less than the setpoint pressure. Of course, if the setpoint and measured pressures are the same, then no adjustment of the choke 34 is required. This process is preferably automated, so that no human intervention is required, although human intervention may be used, if desired.

The controller 96 may also be used to control operation of the standpipe flow control devices 76, 78 and the bypass flow control device 74. The controller 96 can, thus, be used to automate the processes of diverting flow of the fluid 18 from the standpipe line 26 to the bypass line 72 prior to making a connection in the drill string 16, then diverting flow from the bypass line to the standpipe line after the connection is made, and then resuming normal circulation of the fluid 18 for drilling. Again, no human intervention may be required in these automated processes, although human intervention may be used if desired, for example, to initiate each process in turn, to manually operate a component of the system, etc.

Figure 4:
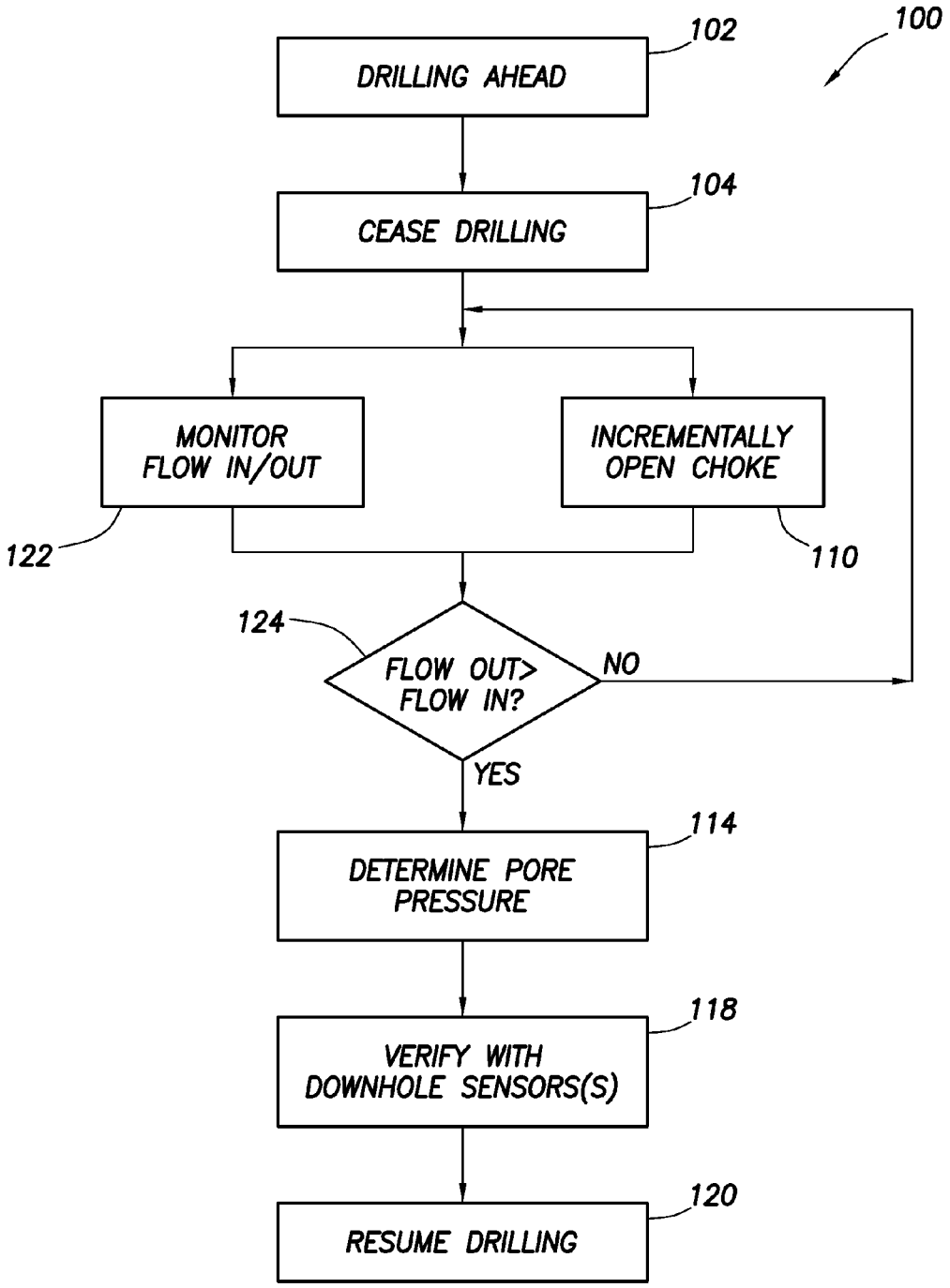
FIG. 4 is a representative flowchart for another version of the formation testing method.

Referring additionally now to FIG. 4, a method 100 of testing an earth formation 82 (see FIG. 1) is representatively illustrated in flowchart form. The method 100 may be performed in conjunction with the well system 10 described above, or it may be performed with other well systems. Thus, the method 100 is not limited to any of the details of the well system 10 described herein or depicted in the drawings.

In step 102, the method 100 begins while drilling ahead. In the well system 10, drilling fluid 18 is circulated through the drill string 16 and annulus 20 while the drill bit 14 is rotated. It is not necessary for the entire drill string 16 to continuously rotate during drilling, since a drill motor or mud motor (not shown) can be used to impart rotation to the drill bit without rotating the entire drill string.

While drilling ahead, the annulus 20 is sealed from the earth's atmosphere by the rotating control device 22. Of course, if the drill string 16 does not rotate during drilling, then the annulus 20 could be sealed by a device which does not rotate with the drill string.

In step 104, drilling of the formation 82 is ceased. The drill bit 14 is preferably picked up out of contact with the formation 82, so that the drill bit does not cut into the formation. Conditions such as drill string torque, wellbore 12 pressure (e.g., as measured by the downhole sensors 60), annulus 20 pressure at the surface (e.g., as measured by sensors 36, 38, 40), etc., can be measured now for reference purposes.

In step 106, circulation of the fluid 18 through the drill string 16 is ceased. Ceasing circulation removes from wellbore pressure the friction pressure due to flow of the fluid 18 through the annulus 20. Therefore, a small reduction in pressure in the wellbore 12 should result from ceasing circulation.

If the sensors 60 are in communication with the surface by, for example, wireless telemetry (e.g., acoustic or electromagnetic telemetry), or wired communication (e.g., via electrical, optical, etc., lines to the surface), then wellbore pressure measurements may be obtained throughout the method 100. If circulation of the fluid 18 is necessary for communication of measurements from the sensors 60 to the surface, then the measurements can be obtained after circulation is resumed (see step 116).

In step 108, flow out of the annulus 20 is monitored while, in step 110, the choke 34 is incrementally opened. As discussed above, while the fluid 18 is circulating through the drill string 16 and annulus 20, further opening the choke 34 will result in reducing backpressure applied to the annulus, thereby reducing pressure in the wellbore 12. While the fluid 18 is not circulated, however, incrementally opening the choke 34 will result in decreasing pressure in the wellbore 12 at a faster rate.

In step 112, after incrementally opening the choke 34, flow out of the wellbore 12 is checked to see if the flow is greater than that due to only the reduction in pressure in the wellbore. If not, then the choke 34 is further incrementally opened (i.e., the method 100 returns to steps 108, 110).

If the flow out of the wellbore 12 is greater than would be due to the reduction in pressure in the wellbore (the hydraulics model 92 can determine when this occurs), this is an indication that an influx 84 of formation fluid from the formation 82 into the wellbore (see FIG. 1) has occurred. The influx 84 will occur when pressure in the wellbore 12 is approximately equal to, or slightly less than, pore pressure in the formation 82. Thus, by detecting when the influx 84 occurs, and determining what the wellbore 12 pressure is when the influx occurs, the approximate formation 82 pore pressure can be determined.

In step 114, the pore pressure is determined. If the sensors 60 are in communication with the surface at the time the influx 84 is detected, then the pressure in the wellbore 12 can be measured directly in real time. The formation 82 pore pressure is approximately the same as the pressure in the wellbore 12 when the influx 84 occurs.

If the sensors 60 are not in communication with the surface at the time the influx 84 is detected (e.g., if mud pulse telemetry is used to communicate sensor measurements to the surface), then the sensor measurements can be obtained when circulation is resumed in step 116. Alternatively, or in addition, pressure in the annulus 20 at the surface (e.g., as measured by sensors 36, 38, 40) can be added to hydrostatic pressure due to the static column of the fluid 18 in the annulus. This sum is approximately equal to the formation 82 pore pressure.

In step 116, circulation of the fluid 18 through the drill string 16 and annulus 20 is resumed. Wellbore 12 pressure measurements can be obtained from the sensors 60 at this point using mud pulse telemetry, in case the sensor measurements were not accessible after step 106.

In step 118, the pore pressure determined in step 114 is verified using measurements from the downhole sensors 60. The pore pressure may have previously been calculated from surface pressure measurements, density of the drilling fluid 18, etc. However, any such calculations of pore pressure are preferably verified in step 118 with actual wellbore 12 pressure measurements near the formation 82 using the downhole sensors 60. Of course, if the downhole sensors 60 were used for measuring the wellbore 12 pressure and determining the pore pressure, then the verifying step 118 may not be performed.

In step 120, drilling is resumed. The drill bit 14 is again rotated, and the drill string 16 is set down to cut into the formation 82. Since the formation 82 pore pressure has now been measured, pressure in the wellbore 12 can be more accurately controlled relative to the pore pressure to achieve managed pressure drilling objectives (reduced formation damage, reduced fluid loss, etc.). This is far preferable to relying on offset well data for pore pressure gradient to predict pore pressure in the formation 82.

Figure 3:
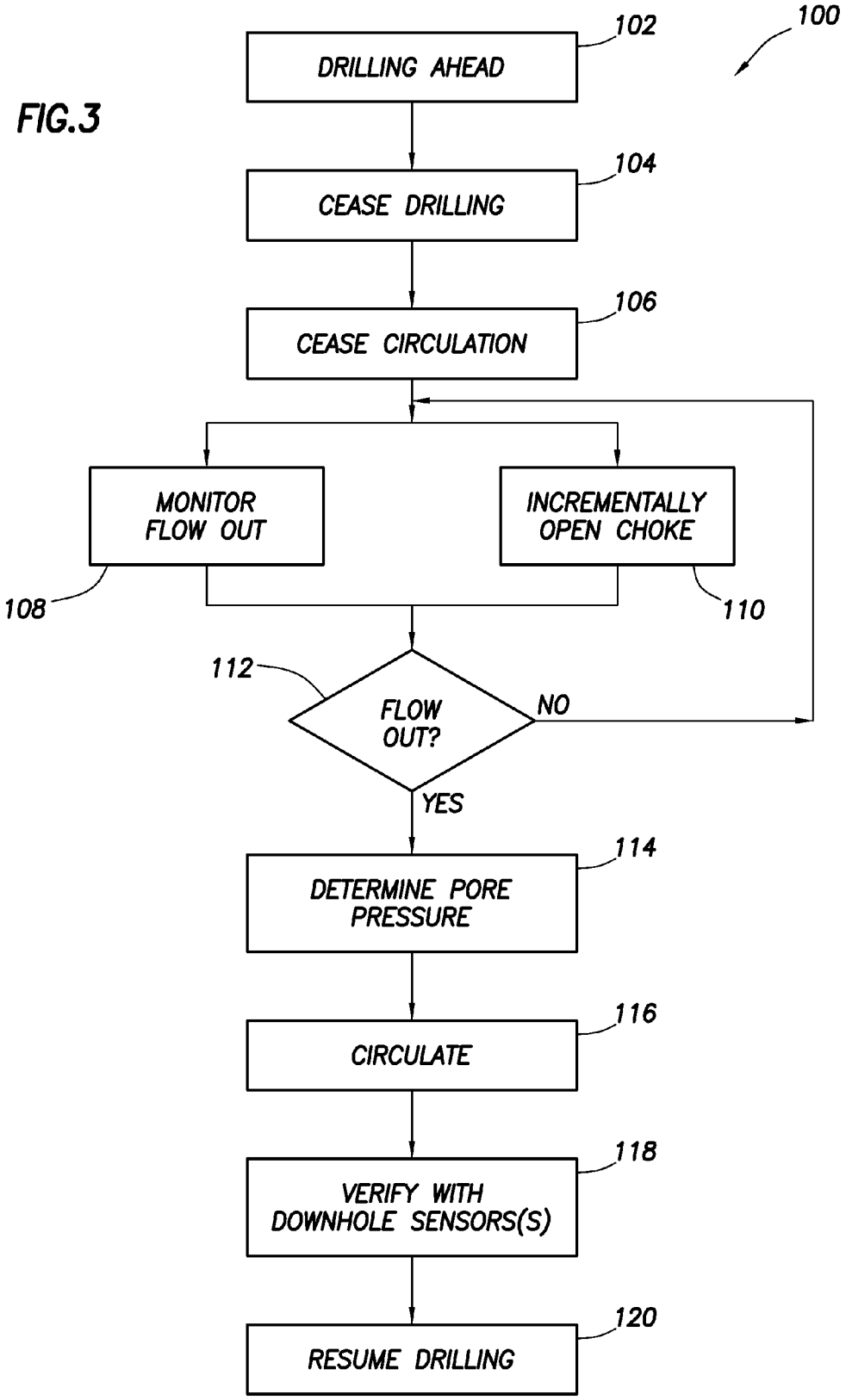
FIG. 3 is a representative flowchart for a method of testing a formation, which method can embody principles of this disclosure.

Another version of the method 100 is representatively illustrated in FIG. 4. In this version, circulation of the fluid 18 through the drill string 16 and annulus 20 continues while the choke 34 is incrementally opened and the pore pressure is determined. Thus, steps 106 and 116 of the FIG. 3 version are not used in the FIG. 4 version of the method 100.

In addition, instead of the step 108 of monitoring flow out of the wellbore 12 while the choke 34 is incrementally opened, the method 100 of FIG. 4 includes a step 122, in which flow both into and out of the wellbore is monitored. The flowmeter 66 can be used to monitor flow into the wellbore 12, and the flowmeter 58 can be used to monitor flow out of the wellbore.

Furthermore, instead of the step 112 of determining whether flow out of the wellbore 12 is greater than that due to reducing pressure via the choke, the method 100 of FIG. 4 includes a step 124, in which it is determined whether flow out of the wellbore is greater than flow into the wellbore. If the flow out of the wellbore 12 is greater than flow into the wellbore, this is an indication that the influx 84 is occurring.

If the flow out of the wellbore 12 is not greater than flow into the wellbore, then the influx 84 is not occurring, and the choke 34 is again incrementally opened. These steps are repeated, until the influx 84 is detected.

Pore pressure in the formation 82 will be approximately equal to, or slightly greater than, pressure in the wellbore 12 when the influx 84 occurs. The sensors 60 can be used to measure pressure in the wellbore 12 in real time. Since the fluid 18 continues to flow through the drill string 16 and annulus 20, mud pulse telemetry can be used, if desired, to transmit pressure and other sensor measurements to the surface.

Alternatively, or in addition, pressure in the annulus 20 at the surface (e.g., as measured by sensors 36, 38, 40) can be added to hydrostatic pressure due to the static column of the fluid 18 in the annulus, and friction pressure due to flow of the fluid through the annulus. This sum is approximately equal to the formation 82 pore pressure.

It can now be fully appreciated that this disclosure provides significant advancements to the art of formation testing. In certain examples described above, a formation 82 can be efficiently tested in conjunction with managed pressure drilling. Furthermore, in certain examples described above, a pore pressure of the formation 82 can be readily determined.

The above disclosure provides to the art a method 100 of testing an earth formation 82. The method 100 can include incrementally opening a choke 34 while drilling into the formation 82 is ceased, thereby reducing pressure in a wellbore 12. An influx 84 into the wellbore 12 (due to reducing pressure in the wellbore 12) is detected.

The method 100 can also include verifying the pressure in the wellbore 12 with at least one pressure sensor 60 in the wellbore 12.

The method 100 can include ceasing circulation of drilling fluid 18 through a drill string 16 prior to incrementally opening the choke 34. The method may also include verifying the pressure in the wellbore 12 with at least one pressure sensor 60 in the wellbore 12, after resuming circulation of the drilling fluid 18 through the drill string 16.

Incrementally opening the choke 34 is typically performed multiple times. Incrementally opening the choke 34 may cease when the influx 84 is detected.

Detecting the influx 84 can include detecting how fluid 18 flows out of the wellbore 12, and/or detecting when fluid flow out of the wellbore is greater than fluid 18 flow into the wellbore 12.

The method 100 can include determining approximate formation 82 pore pressure as pressure in the wellbore 12 when the influx 84 is detected. Determining the approximate formation 82 pore pressure can include summing pressure in the annulus 20 near the surface with hydrostatic pressure in the wellbore 12, or determining approximate formation 82 pore pressure can include summing pressure in the annulus 20 near the surface with hydrostatic pressure in the wellbore 12 and friction pressure due to circulation of fluid through the wellbore.

The method 100 can also include, prior to incrementally opening the choke 34, drilling into the formation 82, with an annulus 20 between a drill string 16 and the wellbore 12 being pressure isolated from atmosphere.

Also described above is the method 100 of testing an earth formation 82, which method can include: drilling into the formation 82, with an annulus 20 between a drill string 16 and a wellbore 12 being pressure isolated from atmosphere; ceasing circulation of drilling fluid 18 through the drill string 16; detecting an influx 84 into the wellbore 12 due to reduced pressure in the wellbore 12 while circulation is ceased; and determining approximate formation 82 pore pressure as pressure in the wellbore 12 when the influx 84 is detected.

The above disclosure also describes the method 100 of testing an earth formation 82, which method can include: drilling into the formation 82, with an annulus 20 between a drill string 16 and a wellbore 12 being pressure isolated from atmosphere; then incrementally opening a choke 34 while drilling is ceased, thereby reducing pressure in the wellbore 12; detecting an influx 84 into the wellbore 12 due to reducing pressure in the wellbore 12; and determining approximate formation 82 pore pressure as pressure in the wellbore 12 when the influx 84 is detected.

Although the method 100 is described above in conjunction with managed pressure drilling of the wellbore 12, it will be appreciated that the method can be practiced in conjunction with other drilling methods, such as, other drilling methods which include isolating the annulus 20 from the earth's atmosphere (e.g., using a rotating control device 22 or other annular seal) at or near the surface. For example, the method 100 could be used in conjunction with underbalanced drilling, any drilling operations in which the annulus 20 is pressurized at the surface during drilling, etc.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore, whether the wellbore is horizontal, vertical, inclined, deviated, etc. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of testing an earth formation, comprising:

circulating a drilling fluid in a wellbore formed in the earth formation;

ceasing circulation of the drilling fluid;

then incrementally opening a choke while drilling into the earth formation and circulation of the drilling fluid are ceased, thereby reducing pressure in the wellbore;

detecting an influx in the wellbore due to the reducing pressure in the wellbore;

verifying the pressure in the wellbore with a pressure sensor in the wellbore; and wherein incrementally opening the choke is performed multiple times and ceases when the influx is detected.

2. The method of claim 1, wherein circulation of the drilling fluid is through a drill string.

3. The method of claim 2, wherein verifying the pressure in the wellbore with the pressure sensor is after resuming circulation of the drilling fluid through the drill string.

4. The method of claim 1, wherein detecting the influx comprises detecting how fluid flows out of the wellbore.

5. The method of claim 1, wherein detecting the influx comprises detecting when fluid flow out of the wellbore is greater than fluid flow into the wellbore.

6. The method of claim 1, further comprising determining approximate formation pore pressure as pressure in the wellbore when the influx is detected.

7. The method of claim 6, wherein determining approximate formation pore pressure comprises summing pressure in the annulus near the surface with hydrostatic pressure in the wellbore.

8. The method of claim 6, wherein determining approximate formation pore pressure comprises summing pressure in the annulus near the surface with hydrostatic pressure in the wellbore and friction pressure due to circulation of fluid through the wellbore.

9. The method of claim 1, further comprising, prior to incrementally opening the choke, drilling into the formation, with an annulus between a drill string and the wellbore being pressure isolated from atmosphere.

10. A method of testing an earth formation, the method comprising:

drilling into the earth formation, with an annulus between a drill string and a wellbore being pressure isolated from atmosphere;

circulating a drilling fluid in the wellbore;

ceasing circulation of the drilling fluid;

then incrementally opening a choke while drilling is ceased, thereby reducing pressure in the wellbore;

detecting an influx into the wellbore due to the reducing pressure in the wellbore;

determining approximate formation pore pressure as pressure in the wellbore when the influx is detected;

verifying the pressure in the wellbore with a pressure sensor in the wellbore; and wherein incrementally opening the choke is performed multiple times and ceases when the influx is detected.

11. The method of claim 10, wherein circulation of the drilling fluid is through the drill string.

12. The method of claim 11, wherein verifying the pressure in the wellbore with the pressure sensor is after resuming circulation of the drilling fluid through the drill string.

13. The method of claim 10, wherein detecting the influx comprises detecting how fluid flows out of the wellbore.

14. The method of claim 10, wherein detecting the influx comprises detecting when fluid flow out of the wellbore is greater than fluid flow into the wellbore.

15. The method of claim 10, wherein determining approximate formation pore pressure comprises summing pressure in the annulus near the surface with hydrostatic pressure in the wellbore.

16. The method of claim 10, wherein determining approximate formation pore pressure comprises summing pressure in the annulus near the surface with hydrostatic pressure in the wellbore and friction pressure due to circulation of fluid through the wellbore.

* * * * *